United States Patent [19]

Greaves

[11] Patent Number: 4,747,501

[45] Date of Patent: May 31, 1988

[54] CONTAINER CLOSURE METHOD

[75] Inventor: Dennis Greaves, Colchester, United Kingdom

[73] Assignee: National Plastics Limited, United Kingdom

[21] Appl. No.: 70,894

[22] Filed: Jul. 8, 1987

[51] Int. Cl.[4] ..... B65D 1/02

[52] U.S. Cl. ..... 215/253; 215/32; 215/226; 215/228; 215/257; 220/266; 220/276; 222/541

[58] Field of Search ..... 215/32, 226, 253, 257, 215/301; 220/266, 276; 222/83, 541, 546; 206/222

[56] References Cited

U.S. PATENT DOCUMENTS

| | | | |
|---|---|---|---|
| 3,025,989 | 3/1962 | Williams | 215/257 X |
| 3,339,812 | 9/1967 | Meissner | 220/278 X |
| 4,402,417 | 9/1983 | Corrigan, Jr. et al. | 215/253 X |
| 4,405,053 | 9/1983 | Cherot | 215/32 |
| 4,527,700 | 7/1985 | Jupin et al. | 215/226 X |
| 4,591,050 | 5/1986 | Finke et al. | 206/222 |

FOREIGN PATENT DOCUMENTS 0039374 11/1981 European Pat. Off. .

*Primary Examiner*—Stephen Marcus
*Assistant Examiner*—Nova Stucker
*Attorney, Agent, or Firm*—Emrich & Dithmar

[57] ABSTRACT

A container and closure combination, in which the container has a neck with a membrane-closed passage through the neck and the closure is adapted (e.g. screw-threaded) for engagement on the neck and has a projecting stud for separating the membrane from the neck and removing it. The membrane has holding means defining a cavity to receive and engage the outside of the projecting stud and a weakened region surrounding the holding means so that on application of the closure to the container the projecting stud can engage in the cavity and can then press on the membrane to break it at the weakened region leaving the membrane attached to the closure.

5 Claims, 1 Drawing Sheet

CONTAINER CLOSURE METHOD

TECHNICAL FIELD

This invention relates to a closure arrangement for a container, for example a bottle, jar or collapsible tube, having a container neck to receive a closure and with a membrane which closes the passage through the neck until broken away.

DISCUSSION OF PRIOR ART

European Patent Specification No. 0039,374 discloses a closure arrangement of this general kind and in one embodiment described in that patent specification, the membrane closing the passage through the container neck has a hollow peg extending towards the outside of the container and a hollow piercer provided on the closure engages on the outside of the hollow peg on the membrane when the closure is suitably applied to the container neck. At the same time, the annular rim of the hollow piercer, which is formed as a cutting edge, is intended to engage a weakened region of the membrane, around the outer periphery of the hollow peg on the membrane, and to sever the membrane. The membrane can then be removed from the container neck by removing the closure since the membrane remains attached to the closure by the interengagement of the hollow piercer with the outside of the hollow peg.

It is believed that the neatness and reliability of the removal of the membrane can be improved in a closure arrangement of this kind if reliance is not placed on a cutting edge formed on the hollow piercer, which is made of plastics material. Accordingly, the closure arrangement of the present invention does not rely on a cutting edge of plastics material to sever the membrane.

SUMMARY OF THE INVENTION

According to the present invention there is provided a container and closure combination, said container having a neck and a membrane closing a passage through the container neck from inside to outside the container, and said closure being adapted for engagement on said neck and having a projecting stud for separating said membrane from the neck and removing it, said membrane having holding means defining a cavity to receive and engage the outside of said projecting stud, and a weakened region surrounding said holding means so that on application of the closure to the container the projecting stud can engage in said cavity and press on said membrane to break said weakened region leaving said membrane attached to said closure.

The action of the stud on the closure in breaking away the membrane is thus a press-out action and not a cutting action.

The cavity may be constituted by a space within elements upstanding from the membrane. Alternatively, the cavity may be constituted by the space within a recess formed in the membrane.

Whilst the closure may be a push fit on the container neck, it is preferably internally screw-threaded for cooperation with an external screw-thread on the container neck and in this case the holding means and projecting stud are necessarily centrally located on the membrane and closure respectively. The mechanical advantage gained from the screw-threading assists the user in breaking the membrane away from the container. In the case of a push fit cooperation between closure and container, the holding means and projecting stud need not necessarily be centrally located, although location of the closure on the container is simplified if they are, but the configuration must be such as to maintain the press-out action on the weakened region of the membrane on pushing the closure onto the container.

Two embodiments of the invention will now be described with reference to the accompanying drawing in which:

DESCRIPTION OF PREFERRED EMBODIMENTS

Figure 1:
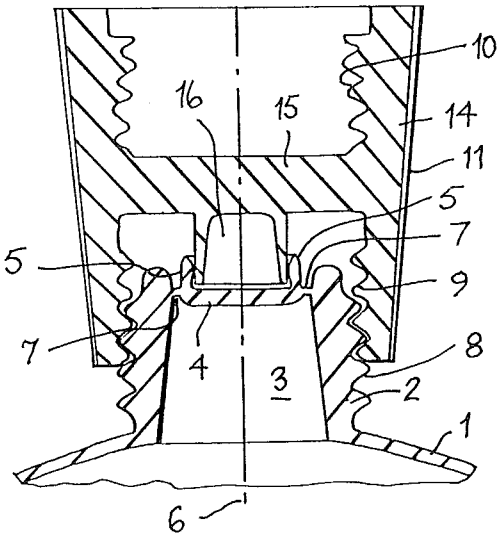
FIG. 1 is a longitudinal section through a first closure arrangement according to the invention.

The embodiment of the invention shown in FIG. 1 is applied to a container 1 having a neck 2 formed from synthetic plastics material, for example polyethylene. The container may be, for example, a bottle, jar or collapsible tube. A passage 3 extends through the neck 2 from the inside to the outside of the container 1 and is closed by a membrane 4 moulded, in this embodiment, integrally with the neck 2 of synthetic plastics material.

The membrane 4 is formed with holding means constituted by an annular hollow stud 5 centrally located on the membrane 4 and thus having an axis coincident with the axis 6 of the neck 2 and the container 1. The hollow stud 5 is upstanding from the membrane 4 in the drawing, that is it extends to the outside of the container 1. Outside the hollow stud 5, that is having a diameter greater than the hollow stud 5, is a weakened, thinner annular region 7 of the membrane 4, which lies between the wall of the annular hollow stud 5 and the inner surface of the neck 2 and, in fact, lies adjacent to the inner surface of the neck 2.

A screw-thread 8 is formed on the outside of the neck 2 to receive a corresponding internal screw-thread 9 or 10 on a closure 11 for the container 1. The closure 11 is so formed that in longitudinal section it has the shape of an H with an annular side wall 14 and a solid disc means 15 dividing the closure 11 into two screw-threaded recesses at approximately a mid-region of the closure.

In FIG. 1, the closure 11 is shown applied to the container neck 2 so that the screw-thread 9 is engaged with the screw-thread 8 on the neck 2. A centrally located cylindrical stud 16 projecting from the disc means 15 has an axis coincident with the axis 6 and an external diameter such that the stud 16 is a push fit within the hollow annular stud upstanding from the membrane 4 that is, if the wall of the hollow stud 5 is regarded as being constituted by elements upstanding from the membrane 4, the space within those elements constituted a cavity to receive the projecting, cylindrical stud 16 and the holding means constituted by those elements engage the outside of the stud 16 to attach the membrane, temporarily, to the stud 16. The length of the cylindrical stud 16 is such that it engages the membrane 4 within the hollow stud 5 before the closure 11 is screwed fully home on the container neck 2. As the closure 11 is screwed further onto the neck 2, the cylindrical stud 16 presses on the membrane 4 within the hollow stud in a manner which may be regarded as exerting a lever action on the weakened region 7 of the membrane, outside the hollow stud 5, and this eventually breaks the weakened region 7 to separate the membrane 4 from the neck 2. The membrane remains attached to the closure 11 as the latter is unscrewed from the container because of the interengagement of the cylindrical stud 16 and the hollow stud 5, the former being a push fit in the latter. The fractured membrane could be removed from the stud 16 and discarded but after the membrane 4 has been broken away from the container neck 2 to allow egress of the container contents, the closure 11 is applied to the neck 2 the other way up so that the screw-thread 10 on the closure 11 now engages with the screw-thread 8 on the neck 2 to close the mouth opening of the neck 2. Thus the fractured membrane 4 will not interfere with further use of the closure and can be left adhering to the stud 16 should that option be preferred.

The cylindrical stud 16 is shown in the embodiment of FIG. 1 as hollow but it may be solid.

Figure 3:
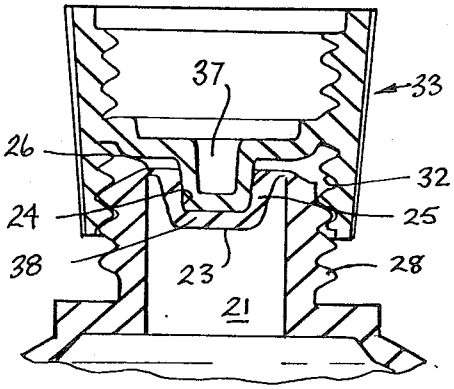
FIG. 3 is a longitudinal section through the closure arrangement of FIG. 2 with the closure applied to the container in a position ready to break the membrane.
Figure 2:
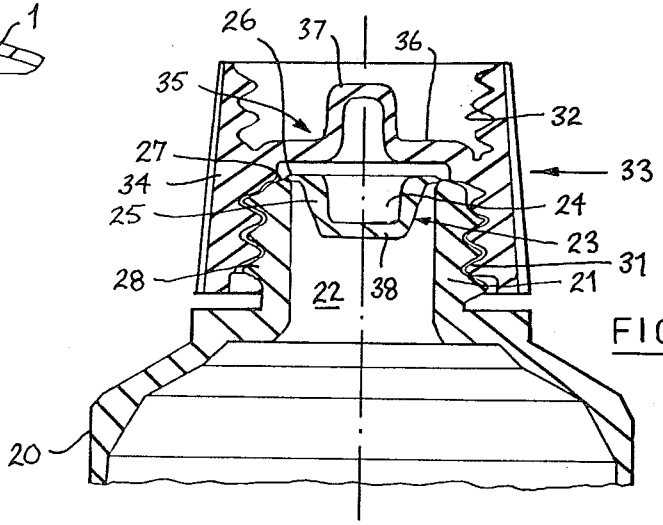
FIG. 2 is a longitudinal section through a second closure arrangement according to the invention in a storage configuration before breaking of the membrane.

The embodiment of the invention shown in FIGS. 2 and 3 is applied to a container 20 having a neck 21 formed from synthetic plastics material, for example polyethylene. A passage 22 from the inside to the outside of the container 20 is closed by a membrane 23 moulded integrally with the neck 21.

The membrane 23 is formed with a central cylindrical recess 24, the peripheral wall 25 of which (which constitutes part of the membrane 23) constitutes centrally located holding means of the membrane 23 for temporarily attaching the membrane 23 to a closure as will be described below. The inner surface of the peripheral wall 25 may have a slight inward taper in the downward direction. Outside the wall 25, that is in a region having a greater diameter than the wall 25, is a weakened, thinner annular region 26 of the membrane 23. As shown in FIG. 2, this weakened region lies between the wall 25 and the neck 21 adjacent the inner surface of the neck 21 at the level of the upper lip 27 of the neck 21.

A screw-thread 28 is formed on the outside of the neck 21 to receive a corresponding screw-thread 31 or 32 on a closure 33. The closure 33 is so formed that in longitudinal section it has approximately the shape of a letter H with an annular side wall 34 and a cross-piece 35 in the form of a disc 36 having a central cylindrical, projecting stud 37. The disc 36 is located at approximately the mid-region of the closure 33 and is moulded in one piece of synthetic plastics material together with its stud 37 and the side wall 34 of the closure 33.

The closure 33 is shown applied to the neck 21 of the container 20 in FIG. 2 in such an attitude that the stud 37 projects outwardly with respect to the container 20, that is away from the membrane 23. This is the appropriate attitude of the closure arrangement for storage of the container prior to breaking of the membrane 23 by the user to gain ingress to the container and/or access to the contents.

In order to break the membrane 23 and allow such ingress or access, the closure 33 is removed from the container 20 and is re-applied in an inverted position (FIG. 3) so that it is now the screw-thread 32 that engages with the screw-thread 28. The central stud 37 is then received in the cavity constituted by the recess 24 and the outer surface of the stud 37 is engaged by the holding means constituted by the wall 25 of the recess 24. The push-fit contact between the stud 37 and the wall 25 (which is enhanced if the wall 25 is slightly inwardly tapered) temporarily attaches the membrane 23 to the closure 33.

When the closure 33 is screwed onto the neck 21 beyond the position shown in FIG. 3, the stud 37 presses against base 38 of the recess 24 eventually causing the membrane 23 to break away from the neck 21 by fracture of the annular region 26. The action of the stud 37 on the membrane 23 may be regarded as a lever action on the weakened region 26 transmitted through the wall 25.

Because the membrane 23 is attached to the closure 33 by interengagement of the stud 37 and the wall 25 of the recess 24, the membrane 23 does not fall into the container 20 but is removed with the closure 33 when the closure 33 is unscrewed. The membrane 23 can then be separated from the closure 33 and disposed of and the closure can be used in the normal way to close the now-unobstructed mouth opening of the neck 21.

The invention is not to be seen as being limited to details of the preferred embodiments illustrated, since modifications thereto are clearly possible within the spirit and scope of the following claims.

What is claimed is:

1. A container and closure combination, said container having a neck and a membrane closing a passage through the container neck from inside to outside the container, and said closure being adapted for engagement on said neck and having a projecting stud for separating said membrane from the neck and removing it, said membrane having holding means defining a cavity to receive and engage the outside of said projecting stud, and a weakened region surrounding said holding means so that on application of the closure to the container the projecting stud can engage in said cavity and press on said membrane to break said weakened region leaving said membrane attached to said closure.

2. A combination according to claim 1, wherein said cavity is constituted by a space within elements upstanding from the membrane.

3. A combination according to claim 1, wherein said cavity is constituted by a space within a recess formed in said membrane.

4. A combination according to claim 1, wherein said container neck has an external screw-thread and said closure has an internal screw-thread for cooperation therewith, and wherein said holding means and projecting stud are located centrally on said membrane and on said closure respectively.

5. A combination according to claim 4, wherein said closure has two screw-threaded recesses separated by a dividing means, each of which screw-threaded recesses can be threadedly engaged with the external screw-thread on the container neck to close the latter, only one of said screw-threaded recesses in the closure containing the projecting stud used for membrane breakage.

* * * * *

UNITED STATES PATENT AND TRADEMARK OFFICE

CERTIFICATE OF CORRECTION

PATENT NO. : 4,747,501

DATED : May 31, 1988

INVENTOR(S) : Dennis Greaves

It is certified that error appears in the above—identified patent and that said Letters Patent is hereby corrected as shown below: On The Title Page:

Cover page, title should be: CONTAINER CLOSURE ARRANGEMENT

Column 1, title should be: CONTAINER CLOSURE ARRANGEMENT; and

Column 2, line 61, "constituted" to --constitutes--.

Signed and Sealed this

Twenty-fifth Day of October, 1988

*Attest:*

DONALD J. QUIGG

*Attesting Officer*

*Commissioner of Patents and Trademarks*